US006560431B2

(12) United States Patent
Hosokawa

(10) Patent No.: US 6,560,431 B2
(45) Date of Patent: May 6, 2003

(54) TONER REPLENISHING DEVICE AND IMAGE FORMING APPARATUS USING THE SAME

(75) Inventor: Hiroshi Hosokawa, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/122,313

(22) Filed: Apr. 16, 2002

(65) Prior Publication Data

US 2002/0164179 A1 Nov. 7, 2002

(30) Foreign Application Priority Data

Apr. 16, 2001 (JP) ..... 2001-117203

(51) Int. Cl.[7] ..... G03G 15/08
(52) U.S. Cl. ..... 399/258; 222/DIG. 1
(58) Field of Search ..... 399/258, 262, 399/106, 261, 117, 119, 120; 222/DIG. 1, 325, 326, 327; 141/363, 383

(56) References Cited

U.S. PATENT DOCUMENTS 4,243,337 A * 1/1981 Hocq ..... 222/325
5,489,747 A 2/1996 Takenaka et al.
5,552,870 A 9/1996 Murakami et al.
5,617,191 A 4/1997 Murakami et al.
5,625,438 A 4/1997 Sugiyama et al.
5,625,440 A 4/1997 Matsumae et al.
5,625,441 A 4/1997 Sugiyama et al.
5,627,630 A 5/1997 Matsumae et al.
5,666,625 A 9/1997 Komatsubara et al.
5,689,782 A 11/1997 Murakami et al.
5,697,026 A 12/1997 Matsumae et al.
5,708,942 A 1/1998 Sugiyama et al.
5,845,183 A 12/1998 Sugiyama et al.
5,879,752 A 3/1999 Murakami et al.
5,970,290 A * 10/1999 Yoshiki et al. ..... 399/262
6,033,818 A 3/2000 Sugiyama et al.
6,163,666 A 12/2000 Hosokawa et al.
6,212,343 B1 4/2001 Hosokawa et al.

FOREIGN PATENT DOCUMENTS

JP 10-020642 1/1998
JP 10-282780 10/1998

* cited by examiner

*Primary Examiner*—Fred L Braun
*Assistant Examiner*—Ryan Gleitz
(74) *Attorney, Agent, or Firm*—Oblon, Spivak, McClelland, Maier & Neustadt, P.C.

(57) ABSTRACT

A toner replenishing device of the present invention includes a container support unit for supporting a removable toner container, which stores toner therein, in a substantially horizontal position. A base unit supports the container support unit such that the support unit is movable between a first position for mounting or dismounting the toner container and a second position for replenishing the toner from the toner container to the body of an image forming apparatus. The container support unit is configured such that when the support unit is located at the first position, the toner container is movable between the support unit and the base unit while the base unit supports the toner container in the substantially horizontal position in a direction in which the toner container is movable.

6 Claims, 7 Drawing Sheets

TONER REPLENISHING DEVICE AND IMAGE FORMING APPARATUS USING THE SAME

BACKGROUND OF THE INVENTION

1. Field of the Invention

The present invention relates to a copier, facsimile apparatus, printer or similar image forming apparatus and a toner replenishing device for replenishing toner thereto.

2. Description of the Background Art

It is a common practice with an image forming apparatus to replenish fresh toner to a developing device via a toner replenishing device, which can be pulled out of the apparatus body by hand. A toner container implemented as a screw bottle is removably mounted to the toner replenishing device in a substantially horizontal position. Such a toner replenishing device allows the user of the apparatus to easily replace the toner container. However, a problem is that when a sufficient space is not available at the user's station for the installation of the apparatus, the toner replenishing device abuts against, e.g., the wall of a room when fully pulled out of the apparatus, obstructing the replacement of the toner container.

Today, a toner container is increasing in size to store a greater amount of toner for thereby increasing the number of prints available with the toner container. However, an increase in the length of the toner container results in an increase in the length of a pedestal that is expected to support the toner container. Consequently, the overall length of the toner replenishing device increases and occupies a broader space when pulled out of the apparatus body. A space broad enough to replace the toner container is not available at some users' stations, discouraging the users from buying a new type of image forming apparatus capable of producing a greater number of prints with a single toner container.

Technologies relating to the present invention are disclosed in, e.g., Japanese Patent Laid-Open Publication Nos. 10-20642 and 10-282780.

SUMMARY OF THE INVENTION

It is an object of the present invention to provide a toner replenishing device capable of reducing a space necessary for the replacement of a toner container, and an image forming apparatus including the same.

A toner replenishing device of the present invention includes a container support unit for supporting a removable toner container, which stores toner therein, in a substantially horizontal position. Abase unit supports the container support unit such that the support unit is movable between a first position for mounting or dismounting the toner container and a second position for replenishing the toner from the toner container to the body of an image forming apparatus. The container support unit is configured such that when the support unit is located at the first position, the toner container is movable between the support unit and the base unit while the base unit supports the toner container in the substantially horizontal position in a direction in which the toner container is movable.

An image forming apparatus including the above toner replenishing device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
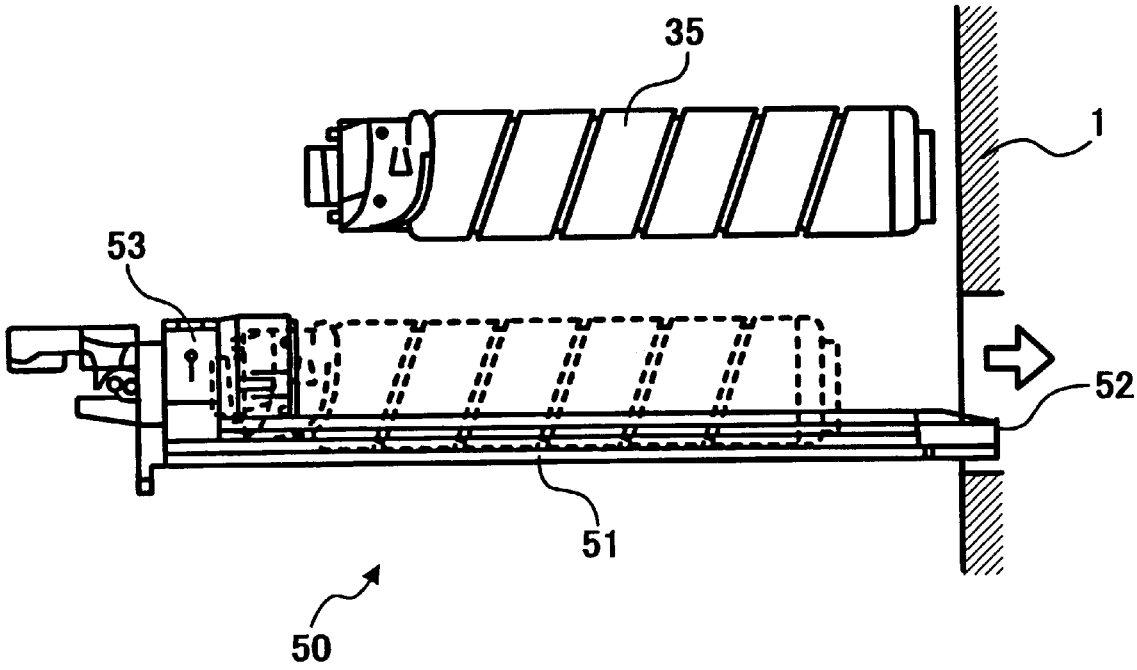
FIG. 1 PRIOR ART
FIG. 1 is a view showing a conventional toner replenishing device.

To better understand the present invention, brief reference will be made to a conventional toner replenishing device, shown in FIG. 1. As shown, the toner replenishing device, generally 50, includes a pedestal 51. A toner container 35 is implemented as a screw bottle packed with toner and openably sealed by a cap. After the toner replenishing device 50 has been fully pulled out of the body 1 of an image forming apparatus, the toner container 35 is laid on the pedestal 51 in a substantially horizontal position. The pedestal 51 is longer than the toner container 35. A stop 52 is formed integrally with the pedestal 51 for preventing the toner container 35 from slipping out of the pedestal 51 into the apparatus body 1.

The toner replenishing device 50 with the toner container 35 set thereon is bodily slid into the apparatus body 1 in a direction indicated by an arrow in FIG. 1. Subsequently, the toner container 35 is rotated about its axis to discharge the toner to a toner storing portion formed inside a cover 53. Thereafter, the toner is conveyed from the toner storing portion to a developing device via a toner outlet, although not shown specifically.

The toner replenishing device 50 with the above configuration has the problems discussed earlier.

Figure 2:
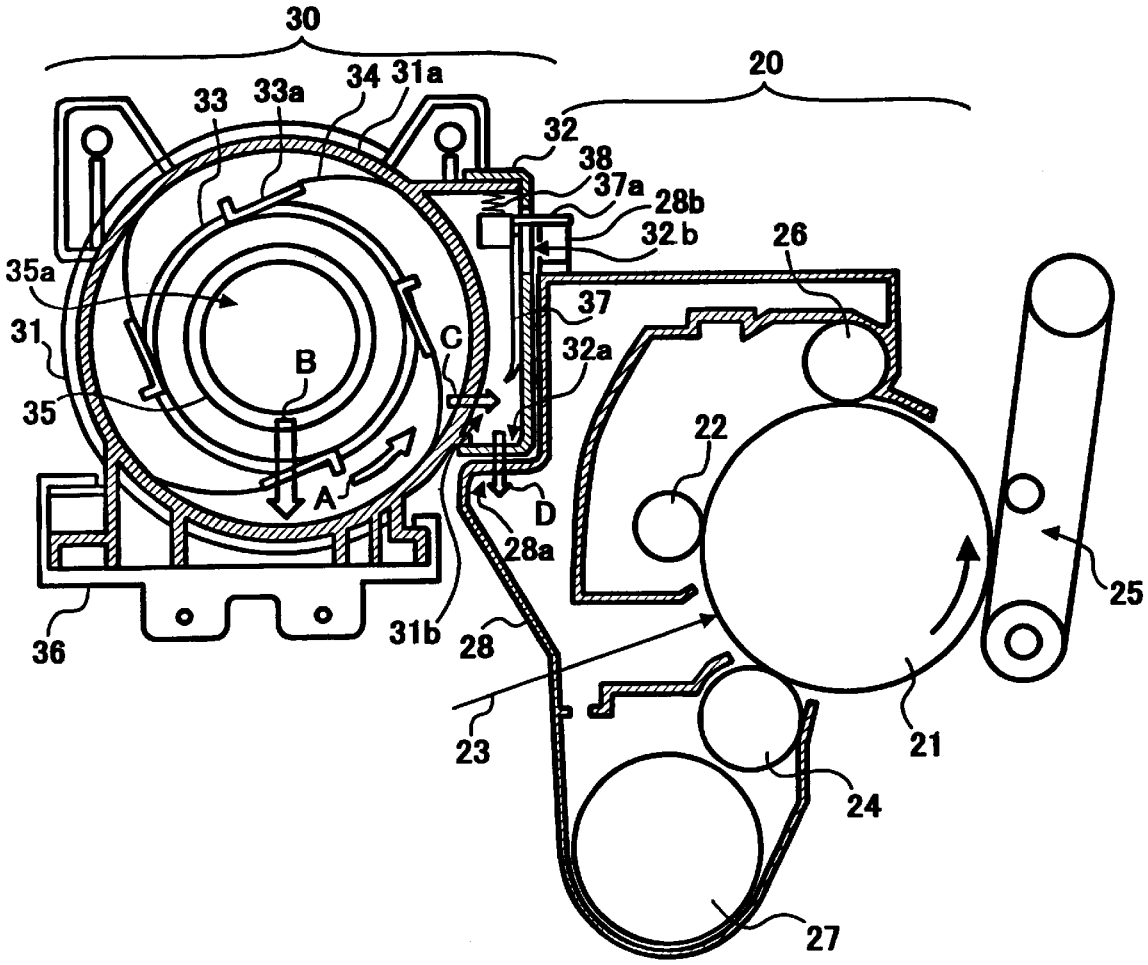
FIG. 2 is a view showing an image forming apparatus embodying the present invention.

Referring to FIG. 2, an image forming apparatus embodying the present invention is shown and implemented as a printer by way of example. As shown, the printer includes a photoconductor unit (PCU hereinafter) 20 in which a photoconductive drum or image carrier 21 is disposed. Arranged around the drum 21 are a charge roller 22, optics represented by a laser beam 23, a sleeve 24, an image transferring device 25, and a drum cleaner 26. The charge roller 22 uniformly charges the surface of the drum 21. The laser beam 23 scans the charged surface of the drum 21 in accordance with image data to thereby form a latent image. The sleeve 24 deposits toner on the latent image for thereby forming a corresponding toner image. The image transferring device 25 transfers the toner image from the drum 21 to a sheet or recording medium. The drum cleaner 26 removes the toner left on the drum 21 after the image transfer. A screw 27 adjoins the sleeve 24 for circulating a developer while agitating it. A case 28 accommodates the drum 21, charge roller 22, sleeve 24 and so forth and is formed with a toner inlet 28*a*.

A toner replenishing device 30 is communicated to the case 28 via the toner inlet 28*a*. More specifically, a pedestal or base 31 and a cover 32, which guides toner to the toner inlet 28*a*, support the toner replenishing device 30. A bottle support member 33 is disposed in the toner replenishing device 30 and rotatable in a direction indicated by an arrow A in FIG. 2. A plurality of paddles 34 are fitted on the bottle support member 33 for replenishing toner.

In operation, while the drum 21 is in rotation, the charge roller 22 uniformly charges the surface of the drum 21 to a preselected potential. The laser beam 23 scans the charged surface of the drum 21 to thereby form a latent image. Toner deposited on the sleeve 24 is transferred to the latent image for thereby forming a corresponding toner image. A sheet is fed from a sheet feeder, not shown, to the image transferring device 25 such that its leading edge meets the leading edge of the toner image. The image transferring device 25 transfers the toner image from the drum 21 to the sheet. The sheet with the toner image, i.e., a print is conveyed to a fixing unit not shown. The fixing unit fixes the toner image on the sheet with heat and pressure. After the image transfer, the drum cleaner 26 removes the toner left on the drum 21 for thereby preparing the drum 21 for the next printing cycle.

The toner replenishing device 30 will be described more specifically hereinafter. In the event of toner replenishment, a drive mechanism, not shown, causes a toner container 35 to rotate in the direction A. In the illustrative embodiment, the toner container 35 is implemented as a bottle and will be referred to as a toner bottle hereinafter. The toner bottle 35 is formed with a spiral ridge 35*b* (see FIG. 5) protruding inward from the inner periphery of the bottle 35. When the toner bottle 35 is in rotation, the spiral ridge 35*b* drives toner stored in the bottle 35 toward a mouth 35*a* in a direction indicated by an arrow B. The bottle support member 33 supports the mouth portion of the toner bottle 35. Ribs 33*a* are formed integrally with the bottle support member 33. The paddles 34 are formed of Mylar, rubber or similar elastic material, and each is adhered to one of the ribs 33*a* by, e.g., a two-sided adhesive tape. In the illustrative embodiment, four paddles 34 are fitted on the bottle support member 33. A case or bottle holding means 31*a* is formed integrally with the pedestal 31 and accommodates the various members stated above.

A rectangular slit 31*b* is formed in the case 31*a* for communicating the mouth 35*a* of the toner bottle 35 to the toner inlet 28*a* of the PCU 20. The slit 31*b* is elongate in the horizontal direction perpendicular to the direction in which the paddles 34 move.

The bottle support member 33 rotates in the direction A along with the toner bottle 35. The paddles 34 fitted on the ribs 33*a* of the bottle support member 33 move integrally with the support member 33, replenishing the toner via the slit 31*b* in the direction C.

The cover 32 is mounted on the case 31*a* for guiding the toner delivered via the slit 31*b* to the toner inlet 28*a* of the PCU 20 in a direction indicated by an arrow D. A toner outlet 32*a* is formed in the lower portion of the cover 32 and held in alignment with the toner inlet 28*a*. A shutter 37 is mounted on the case 31*a* inside of the cover 32 in order to selectively block or unblock the toner outlet 32*a*.

A guide plate 36 is affixed to the front and rear walls of a printer body, not shown, and supports the toner replenishing device 30. The toner replenishing device 30 is therefore generally made up of a mechanism including the case 31*a* and the bottle support member 33 and other movable parts accommodated in the case 31*a*, the toner bottle 35 removably mounted to the above mechanism, and drive means. The pedestal 31 is slidable on the guide plate 36 out of the toner replenishing device 30 in the direction perpendicular to the sheet surface of FIG. 2, so that a person can mount or dismount the toner bottle 35, as desired.

A lever 37*a* extends from the shutter 37 to the outside of the toner replenishing device 30 via an opening 32*b* formed in the cover 32. When the toner replenishing device 30 is moved, the lever 37*a* slides on a slant 28*b* included in the case 28 to thereby open or close the shutter 37. More specifically, the slant 28*b* increases in height from the front side toward the rear side of the printer body, as viewed in FIG. 2. When the toner replenishing device 30 is moved into the printer body, the lever 37*a* slides upwardly along the slant 28*b* and lifts the shutter 37 to a position where it unblocks the toner outlet 32*a*. In this condition, a spring 38 constantly biases the shutter 37 toward a position where it blocks the toner outlet 32*a*. Therefore, when the toner replenishing device 30 is moved out of the printer body, the shutter 37 moves downwardly along the slant 28*b* to the position where it blocks the toner outlet 32*a*.

Figure 3:
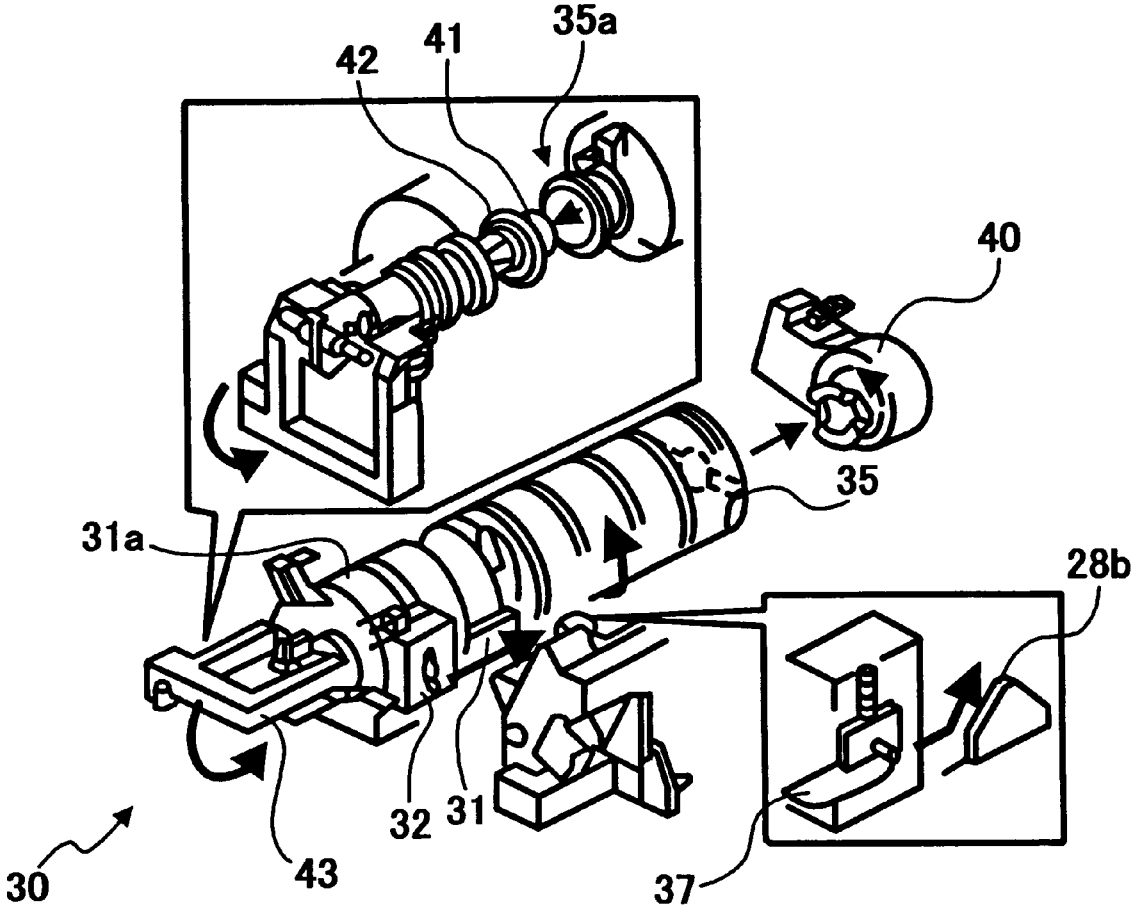
FIG. 3 is an isometric view showing a toner replenishing device included in the illustrative embodiment in a position pulled out of the apparatus body.
Figure 4:
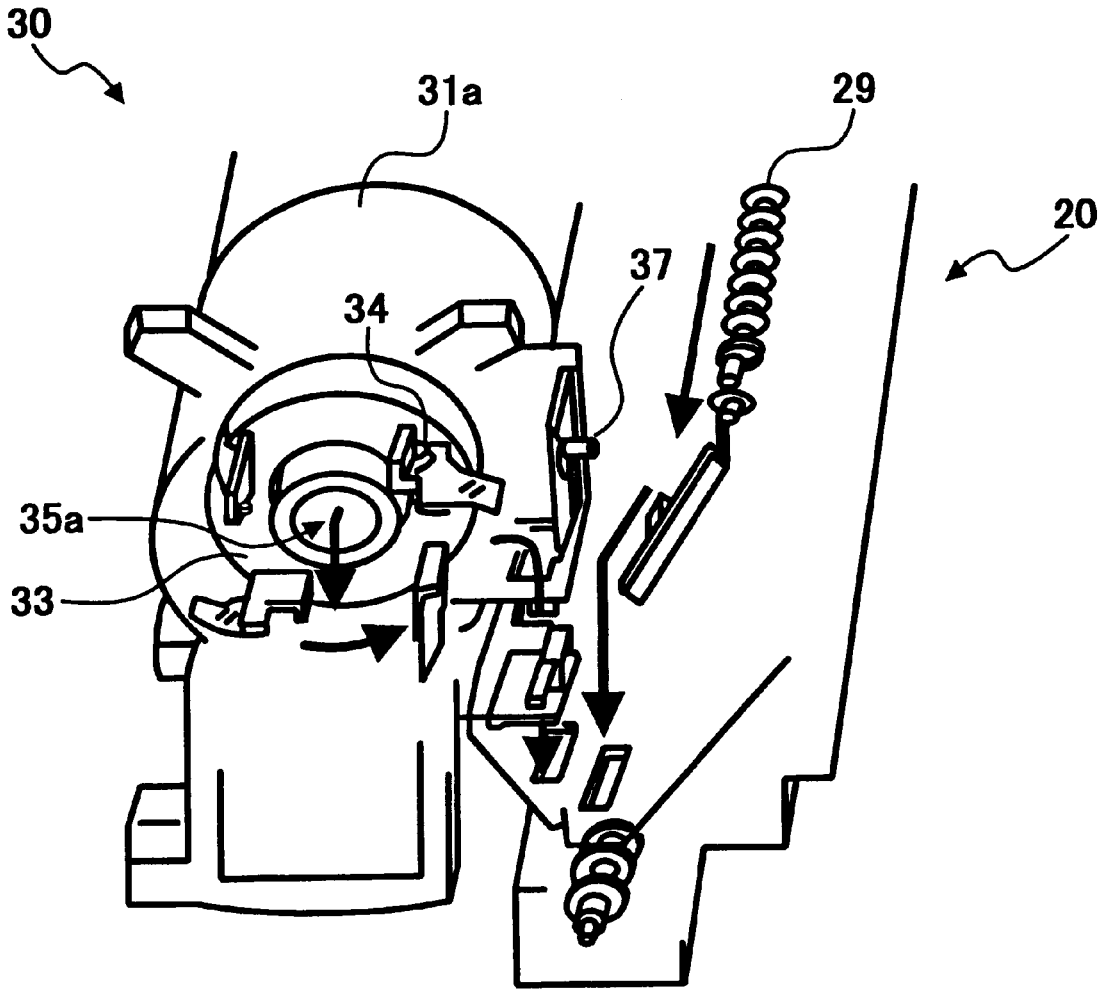
FIG. 4 is an isometric view showing the toner replenishing device in a position ready to replenish toner to a photoconductor unit arranged in the apparatus.

How the toner replenishing device loaded with the toner bottle 35 is set on the printer body will be described hereinafter. FIG. 3 shows the toner replenishing device 30 pulled out of the printer body and the toner bottle 35 mounted to the pedestal 31. A person slides the toner replenishing device 30 loaded with the toner bottle 35 along the guide plate 36, FIG. 2, in a direction indicated by an arrow E until the pedestal 31 abuts against a wall not shown. As a result, the toner replenishing device 30 is set at a preselected position inside the printer body. At the same time, the bottom of the toner bottle 35 is operatively connected to a driving device 40, so that the driving device 40 can cause the toner bottle 35 to rotate.

As shown in a fragmentary enlarged view at the left portion of FIG. 3, a cap 41 is fitted on the toner bottle 35 for preventing the toner from being discharged by accident. A collet chuck 42 is disposed in the case 31*a* for chucking the cap 41.

After the toner replenishing device 30 has been set in the printer body, the person turns a handle 43 downward, as viewed in FIG. 3, so that the toner bottle 35 is pulled with its cap 41 being chucked by the collet chuck 42. As a result, the cap 41 is removed from the mouth 35*a* of the toner bottle 35. The toner is therefore partly discharged from the toner bottle 35 to the case 31*a* via the mouth 35*a*. This is the end of the manual operation for setting the toner replenishing device 30. When a motor included in the driving device 40 causes the toner bottle 35 to rotate, the spiral ridge 35*b* of the toner bottle 35 drives the toner out of the bottle 35 via the mouth 35*a*. The paddles 34 replenish the toner to the PCU 20. The toner introduced into the PCU 20 is used for development together with recycled toner conveyed by a screw 29.

To pull the toner replenishing device 30 out of the printer body, a person performs the above-described procedure in the reverse order. Specifically, a person turns the handle 43 upward to unlock the toner replenishing device 30. At this instant, the collet chuck 42 fits the cap 41 on the mouth 35*a* of the toner bottle 35. The person then pulls the toner replenishing device 30 out of the printer body while holding the handle 43. In this condition, the toner bottle 35 is ready to be removed.

The conventional toner replenishing device shown in FIG. 1 includes the stop 52 for preventing the toner bottle 35 from slipping out of the pedestal 51 into the apparatus body. A person is therefore required to handle the toner bottle 35 after pulling the whole toner replenishing device 50 out of the apparatus body. This increases a space necessary for the replacement of the toner bottle 35.

By contrast, the illustrative embodiment allows a person to deal with the toner bottle 35 without fully pulling the toner replenishing device 30 out of the printer body. For this purpose, the illustrative embodiment omits the stop 52. While the toner bottle 35 may slip out of the pedestal 31 and enter the printer body due to the absence of the stop 52, the guide plate 36 maintains the toner bottle 35 in a substantially horizontal position and again sets it on the pedestal 31.

Figure 5:
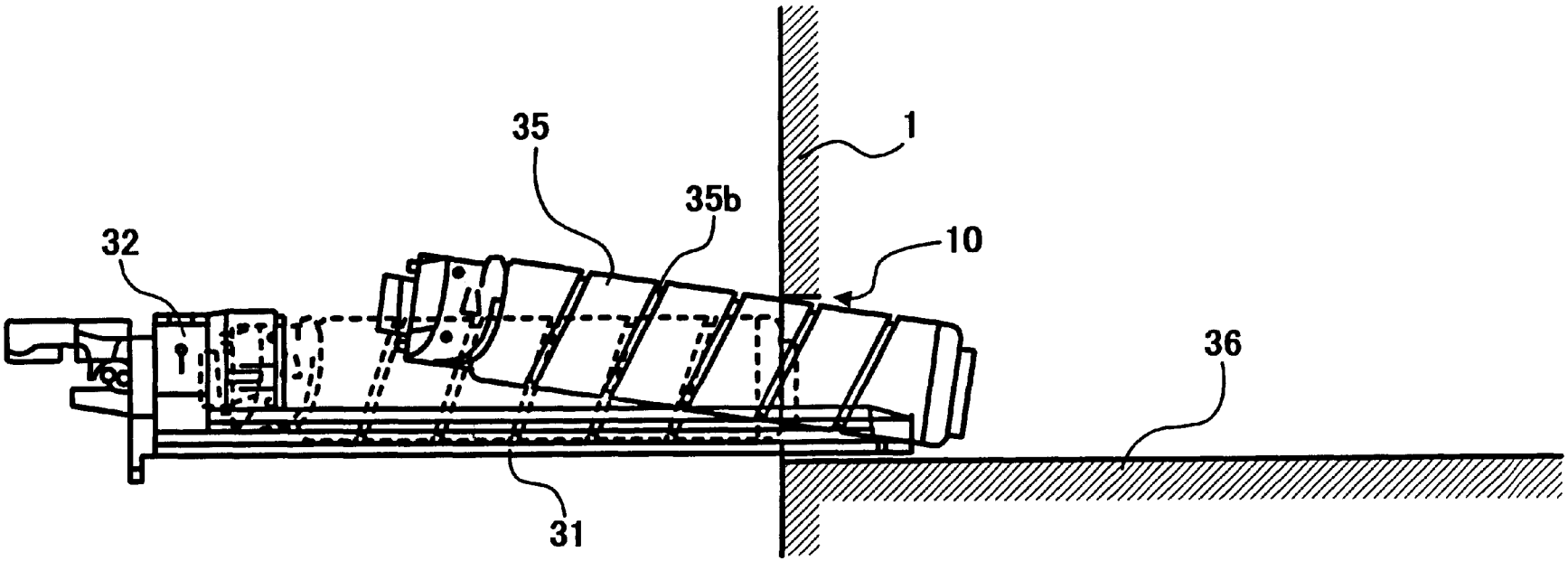
FIG. 5 is a side elevation demonstrating how a toner container is mounted to the toner replenishing device.

More specifically, as shown in FIG. 5, a person intending to set the toner bottle 35 on the toner replenishing device 30 pulls the toner replenishing device out of the printer body. As a result, an opening 10 appears between the toner replenishing device 30 and the printer body. The person then holds the toner bottle 35 in an inclined position and inserts its bottom portion into the opening 10. The bottom portion of the toner bottle can enter the printer body deeper than in the conventional toner replenishing device because the conventional stop is absent. Subsequently, the person lays the toner bottle 35 flat on the pedestal 31, as indicated by a dotted line in FIG. 5. In this manner, the person can set the toner bottle 35 on the pedestal 31 without fully pulling the toner replenishing device 30 out of the printer body. This successfully reduces the space necessary for the replacement of the toner bottle 35.

Figure 6A:
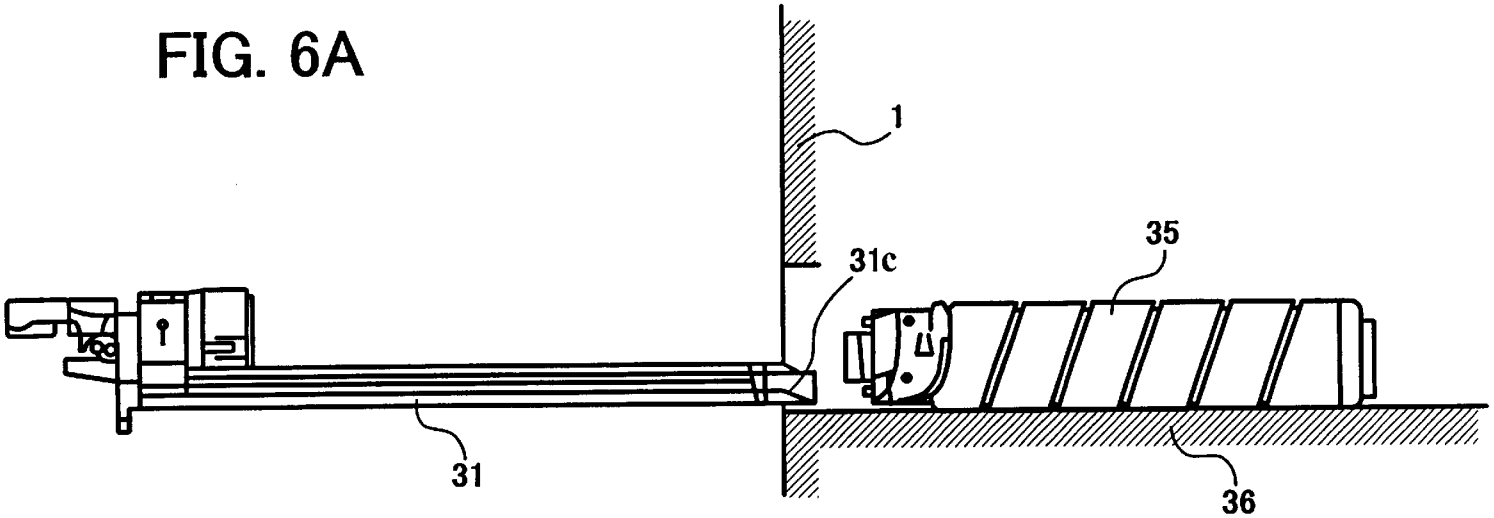
FIG. 6A is a view showing the toner container slipped out of the toner container into the apparatus body.

As shown in FIG. 6A, assume that the toner bottle 35 slips out of the pedestal 31 and bodily enters the printer body. Even in this condition, the guide plate 36 maintains the toner bottle 35 in a substantially horizontal position within the printer body. The pedestal 31 has a tapered end 31*c* on the printer side.

Figure 6B:
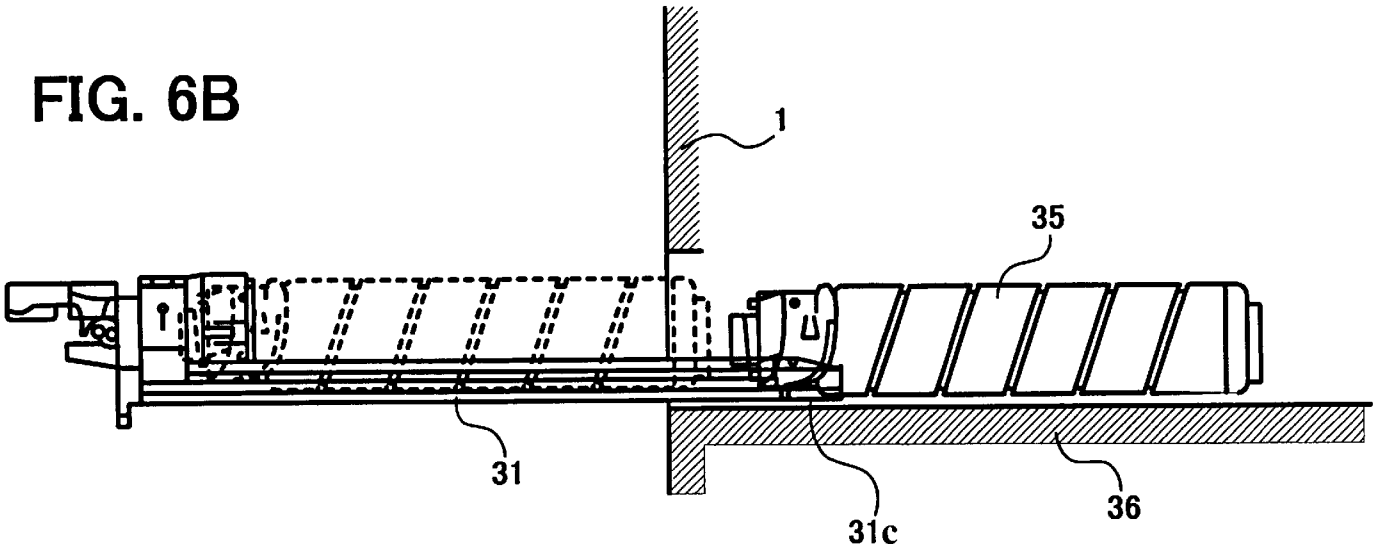
FIG. 6B is a view showing how a pedestal lifts the toner bottle and lays it thereon.

As shown in FIG. 6B, when the person slides the toner replenishing device 30 into the printer body (rightward in FIG. 6B), the tapered end 31*c* of the pedestal 31 lifts the toner bottle 35 away from the guide plate 36. The tapered end 31*c* then guides the toner bottle 35 onto the pedestal 31 moving into the printer body.

Figure 7:
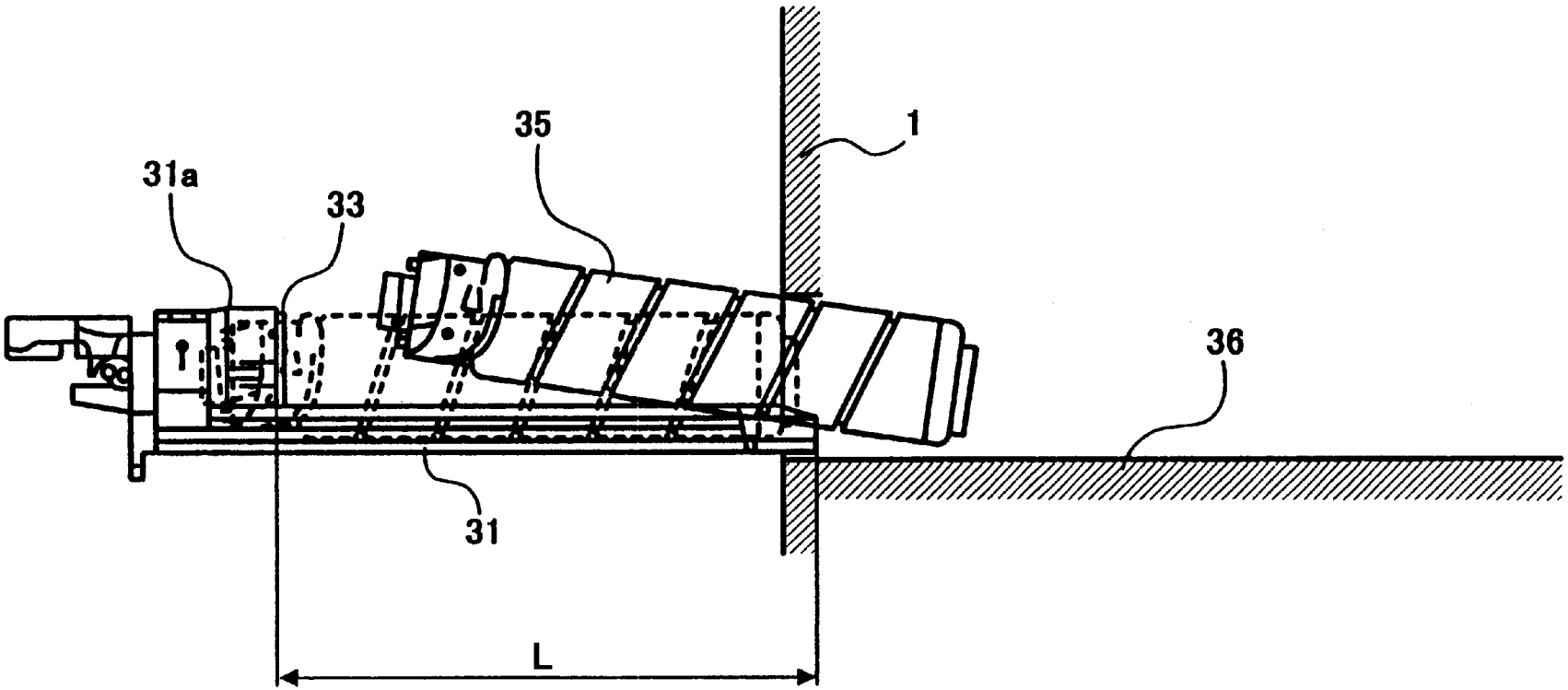
FIG. 7 is a side elevation showing a modification of the illustrative embodiment.

FIG. 7 shows a modification of the illustrative embodiment configured to reduce the overall length of the toner replenishing device 30. As shown, assume that the end of the bottle support member 33 facing the printer body and the end of the pedestal 31 also facing the printer body are spaced by a distance of L. Then, in the modification, the distance L is selected to be smaller than the length of the toner bottle 35. The modification therefore makes the entire toner replenishing device 30 shorter than when the above distance L is greater than the length of the toner bottle 35, thereby further reducing the space necessary for the replacement of the toner bottle 35.

Further, in the modification shown in FIG. 7, the toner replenishing device 30 does not stand in the person's way even when fully pulled out of the printer body, enhancing efficient replacement of the toner bottle 35. Moreover, even when the toner bottle 35 is made longer to store a greater amount of toner, the toner replenishing device 30 does not have to have its overall length increased. In addition, it is possible to increase the amount of toner to be packed in the toner bottle 35 while maintaining the existing size of the printer body.

In summary, in accordance with the present invention, a toner replenishing device allows a toner container to be mounted or dismounted at a position close to a replenishing position. This reduces a displacement required of a container support unit and therefore saves a space necessary for the replacement of the toner container.

Further, assume that the toner container bodily slips out of a pedestal into a base unit at the mounting/dismounting position. Then, when the toner replenishing device is moved from the mounting/dismounting position toward the replenishing position, a tapered end included in the pedestal lifts the toner container in accordance with the movement of the toner replenishing device and guides it onto the pedestal.

The toner replenishing device of the present invention has a smaller overall length than the conventional device. In addition, even when the toner container is made longer to store a greater amount of toner, the toner replenishing device does not have to have its overall length increased. This successfully saves a space for replacement.

Moreover, the toner container can be replaced without the toner support unit being fully pulled out of an image forming apparatus, so that the space necessary for replacement is reduced. In addition, the container support unit does not stand in the operator's way when pulled out. Even when the toner container is increased in size, there can be obviated an increase in the space for replacement and an increase in the overall size of the apparatus.

Various modifications will become possible for those skilled in the art after receiving the teachings of the present disclosure without departing from the scope thereof.

What is claimed is:

1. A toner replenishing device comprising:

a container support unit for supporting a removable toner container, which stores toner therein, in a substantially horizontal position; and a base unit supporting the container support unit such that the container support unit is movable between a first position for mounting or dismounting the toner container and a second position for replenishing the toner from the toner container to a body of an image forming apparatus;

wherein the container support unit is configured such that when the container support unit is located at the first position, the toner container is movable in a downstream direction from being supported by and in contact with the container support unit to being supported by and in contact with the base unit so that the base unit supports the toner container in the substantially horizontal position.

2. The device as claimed in claim 1, wherein the container support unit comprises a pedestal onto which the toner container is to be loaded, the pedestal including a tapered end at a downstream side thereof, the tapered end being tapered in a direction in which the container support unit moves from the first position to the second position, and the tapered end being tapered downwardly from an upstream side to the downstream side of the pedestal.

3. The device as claimed in claim 2, wherein the container support unit further comprises locking means for locking a first end of the toner container, the locking means being positioned at the upstream side of the pedestal in the direction in which the container support unit moves from the first position toward the second position, and the pedestal supports, after the locking member has locked the toner container, a portion of the toner container upstream of a second end of the toner container positioned at the downstream side of the pedestal.

4. In a image forming apparatus including a toner replenishing device for replenishing toner to a body of the image forming apparatus, the toner replenishing device comprising:

a container support unit for supporting a removable toner container, which stores the toner therein, in a substantially horizontal position; and a base unit supporting the container support unit such that the container support unit is movable between a first position for mounting or dismounting the toner container and a second position for replenishing the toner from the toner container to a body of the image forming apparatus;

wherein the container support unit is configured such that when the container support unit is located at the first position, the toner container is movable in a downstream direction from being supported by and in contact with the container support unit to being supported by and in contact with the base unit so that the base unit supports the toner container in the substantially horizontal position.

5. The apparatus as claimed in claim 4, wherein the container support unit comprises a pedestal onto which the toner container is to be loaded, the pedestal including a tapered end at a downstream side thereof, the tapered end being tapered in a direction in which the container support unit moves from the first position to the second position, and the tapered end being tapered downwardly from an upstream side to the downstream side of the pedestal.

6. The apparatus as claimed in claim 5, wherein the container support unit further comprises locking means for locking a first end of the toner container, the locking means being positioned at the upstream side of the pedestal in the direction in which the container support unit moves from the first position toward the second position, and the pedestal supports, after the locking member has locked the toner container, a portion of the toner container upstream of a second end of the toner container positioned at the downstream side of the pedestal.

* * * * *